US005092226A

United States Patent [19]

McCloskey

[11] Patent Number: 5,092,226

[45] Date of Patent: Mar. 3, 1992

[54] INCINERATOR CHIMNEY STACK VALVE MECHANISM

[75] Inventor: James P. McCloskey, Dayton, Ohio

[73] Assignee: ERAtech Inc., Dayton, Ohio

[21] Appl. No.: 626,031

[22] Filed: Dec. 12, 1990

[51] Int. Cl.[5] ..... F23J 11/00; F23C 17/02

[52] U.S. Cl. ..... 454/5; 110/184; 454/30; 454/360

[58] Field of Search ..... 98/59, 60, 58, 122, 98/85; 110/163, 184, 173 B; 126/292, 293

[56] References Cited

U.S. PATENT DOCUMENTS

| | | | |
|---|---|---|---|
| 1,168,579 | 1/1916 | Thorsby . | |
| 2,349,283 | 5/1941 | King et al. . | |
| 2,771,834 | 11/1956 | Goudy . | |
| 3,410,288 | 11/1968 | Hajek | 98/59 |
| 3,545,365 | 12/1970 | Snader | 98/59 |
| 3,745,907 | 7/1973 | Zarfoss et al. . | |
| 4,483,315 | 11/1984 | Carriveau . | |
| 4,497,310 | 2/1985 | Funke . | |
| 4,553,731 | 11/1985 | Carpenter | 110/163 X |
| 4,770,108 | 9/1988 | Ebert | 126/293 X |

*Primary Examiner*—Albert J. Makay
*Assistant Examiner*—William C. Doerrler
*Attorney, Agent, or Firm*—Jacox & Meckstroth

[57] ABSTRACT

An incinerator chimney stack valve mechanism which normally prevents the flow of fluid from the chimney stack. The incinerator chimney stack valve mechanism is mounted upon the chimney stack adjacent an opening in the chimney stack. A closure member is mounted upon an arm member and is movable toward and away from the opening in the chimney stack. An engagement member is mounted upon a second arm member. The second arm member is connected to a motor member which moves the second arm member for engagement of the engagement with the first arm member for movement of the closure member with respect to the opening in the chimney stack. The weight of the engagement member is sufficient to move the first arm member and thereby move the closure member with respect to the opening in the chimney stack if the motor member should fail to function properly.

11 Claims, 2 Drawing Sheets 34
30
20
26
38
16
44a
52
44
50
45
46
12

30
20
24
26
34
16
44a
38
52
44
12
50
45
46

34
30

20
24
26
60
16
44a
30
38
12
60
52
44
50
45
46

34
30
20
16
24
26
44a
38
12
52
44
50
45
46

INCINERATOR CHIMNEY STACK VALVE MECHANISM

BACKGROUND OF THE INVENTION

An incinerator of hazardous materials is required to dispose of all materials burned therein, and the chimney stack associated with the incinerator is employed to conduct gases and other materials from the incinerator only when problems exist within the incinerator or within a disposal system which is associated with the incinerator. Thus, an incinerator chimney stack must be capable of conducting gases and other materials from an incinerator to the atmosphere only when certain predetermined conditions exist.

It is an object of this invention to provide an incinerator chimney stack valve mechanism which is operable between a completely closed condition and a completely open condition.

Another object of this invention is to provide such an incinerator chimney stack valve mechanism which automatically opens when excessive pressures exist within the chimney stack.

It is another object of this invention to provide such an incinerator chimney stack valve mechanism which includes a motor member but which fails-safe and opens the chimney stack if the motor member fails to function properly.

Other objects and advantages of this invention reside in the construction of parts, the combination thereof, the method of construction and the mode of operation, as will become more apparent from the following description.

SUMMARY OF THE INVENTION

This invention comprises an incinerator chimney stack valve mechanism which includes a closure member which normally closes an opening in the upper portion of an incinerator chimney stack. The closure member is attached to an arm member which is movably supported by the chimney stack. The arm member is movable to move the closure member between a condition in which the closure member completely closes the opening in the chimney stack and a condition in which the closure member is spaced from the opening in the chimney stack. The incinerator chimney stack valve mechanism includes motor means for movement of an engagement member which controls movement of the arm member for movement of the closure member. The incinerator chimney stack valve mechanism is structured to permit the closure member to be automatically moved from the opening in the chimney stack when excessive pressures exist within the chimney stack. The incinerator chimney stack valve mechanism also includes means by which the closure member is automatically moved to an open position if the motor means should fail to function properly.

DETAILED DESCRIPTION OF THE PREFERRED EMBODIMENT OF THE INVENTION

Figure 1:
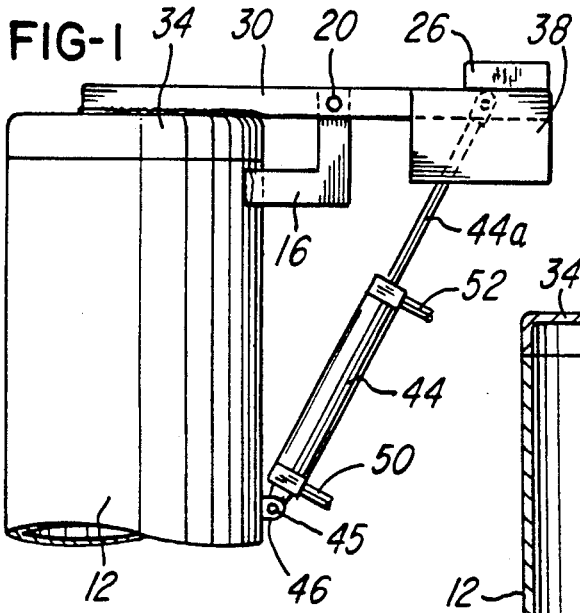
FIG. 1 is a side elevational view showing an incinerator chimney stack valve mechanism of this invention attached to an upper portion of an incinerator chimney stack. This view shows the motor means of the valve mechanism and shows the closure member in a closed position, as the closure member closes an opening in the upper portion of the chimney stack.

Incinerator chimney stack valve mechanism of this invention is adapted to be mounted at the upper portion of an incinerator chimney stack, such as an incinerator chimney stack 12 shown in the drawings. Two spaced-apart L-shape brackets 16 are shown attached to the upper portion of the incinerator chimney stack 12. Extending through the L-shape brackets 16 is a shaft 20. Pivotally mounted upon the shaft 20 between the L-shape brackets 16 are arms 24 which extend in a direction from the chimney stack 12. Attached to arms 24 at a position spaced from the chimney stack 12 is an engagement member 26.

Also, pivotally mounted upon the shaft 20 are arms 30, which extend over the chimney stack 12 and which also extend in a direction from the chimney stack 12. The arms 30 are shown mounted upon the shaft 20, with the brackets 16 between the arms 30. However, of course, any other mounting arrangement of the arms 30 upon the shaft 20 is also satisfactory.

Attached to the arms 30 and adapted to be positioned over an opening in the upper portion of the stack 12 is a closure member 34. Also, attached to the arms 30 are counter-weight members 38 which are shown positioned immediately below the engagement member 26 when the arms 24 and 30 are horizontal. Normally, the pivotal arms 30 are horizontal, and the closure member 34 rests upon the chimney stack 12 as the weight of the closure member 34 is slightly greater than the weight of the counter-weight members 38.

A linearly reciprocal motor member 44 is pivotally attached by a pin 45 to a bracket 46 which is attached to the chimney stack 12 below the brackets 16. The motor member 44 has an actuator element **44*a* which is pivotally attached to one or both of the arms 24. The motor member 44 may, for example, be a fluid operable motor, as shown. The motor member 44 is shown as having fluid conduit elements 50 and 52 connected thereto for flow of fluid into and out of the motor member 44. Thus, operation of the motor member 44 pivotally moves the arms 24 and moves the engagement member 26 toward and away from the arms 30**.

Normally, the motor member 44 pivotally positions the arms 24 so that the engagement member 26 is out of engagement with the arms 30. However, the normal pivotal position of the arms 24 may place the engagement member 26 in engagement with the arms 30 but without urging the arms 30 downwardly.

Figure 2:
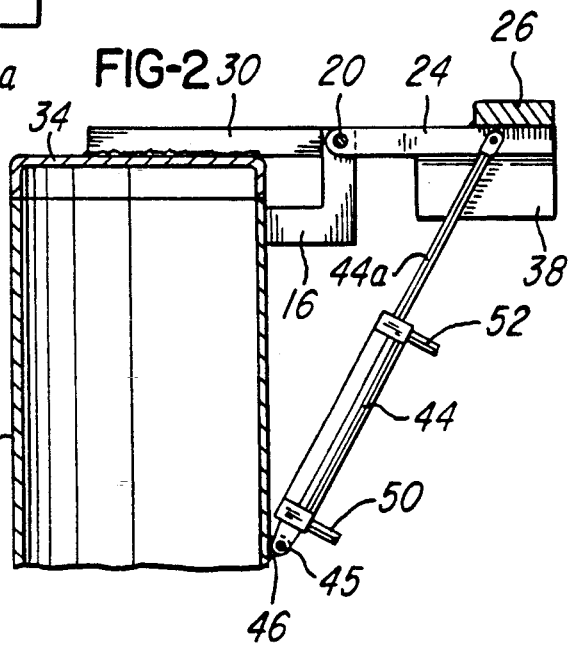
FIG. 2 is a side sectional view showing the upper portion of the chimney stack in section and showing the closure member in a closed position.
Figure 6:
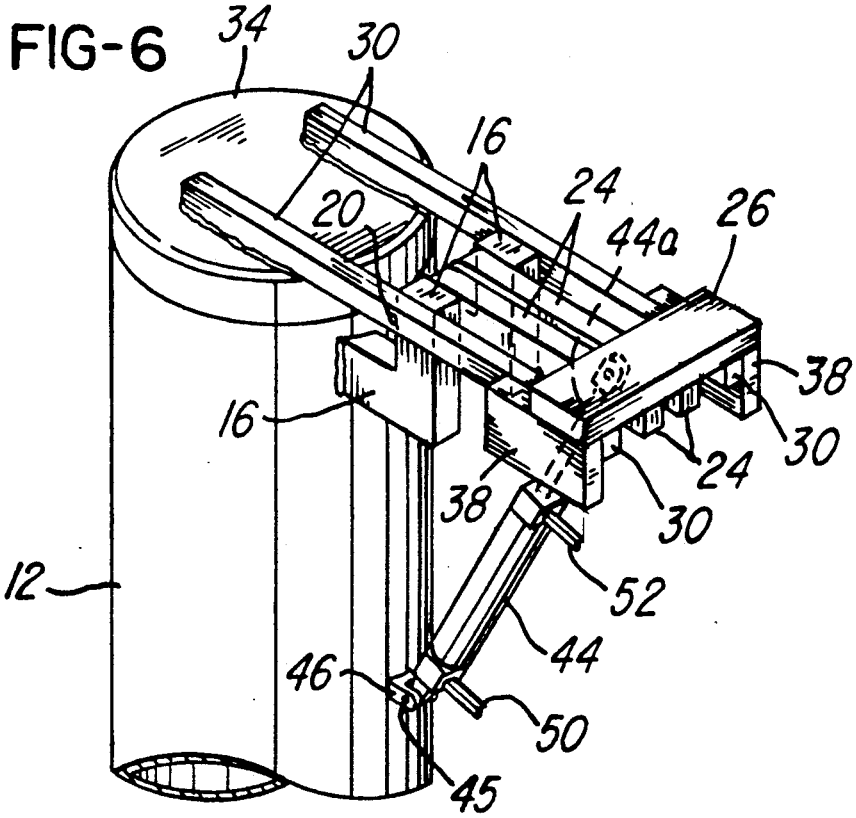
FIG. 6 is a perspective view showing the valve mechanism of this invention attached to the upper portion of the chimney stack as the closure member closes the opening in the chimney stack.

FIGS. 1, 2, and 6 show the arms 24 in a horizontal position as the motor member 44 supports the arms 24 and the engagement member 26 in a horizontal position above the arms 30 which are also horizontal. Thus, in this position the engagement member 26 does not urge pivotal movement of the arms 30. Thus, the closure member 34 rests upon the upper portion of the chimney stack 12 and closes the opening in the upper portion of the chimney stack 12.

This condition is the normal condition of the chimney stack valve mechanism when the chimney stack 12 is in communication with an incinerator which burns hazardous materials and/or materials which create objectionable gases or residue. Therefore, when such materials are burned, the gases or residue therefrom is not permitted to be discharged into the atmosphere. Thus, the chimney stack 12 remains closed by the closure member 34.

Figure 4:
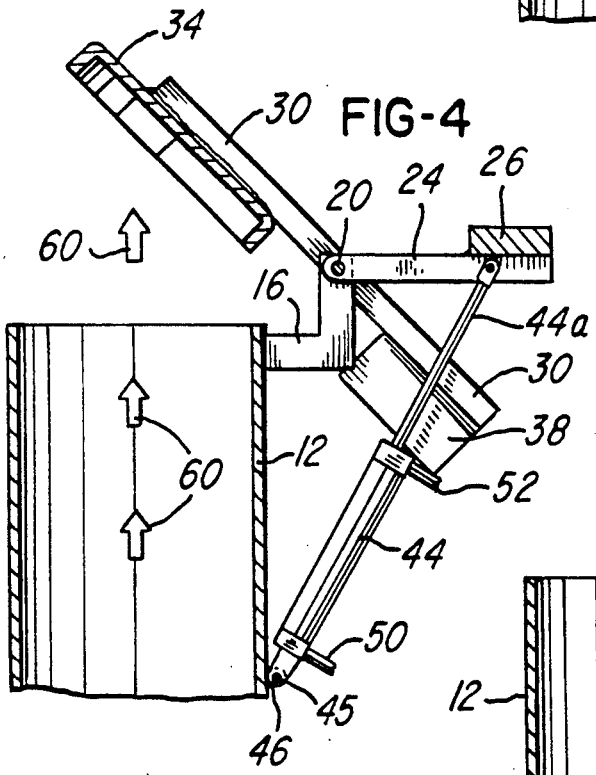
FIG. 4 is a side sectional view, similar to FIGS. 2 and 3, but showing the closure member in an open position established by excessive pressures within the chimney stack.

However, occasions may arise in which there is an explosion or excessive pressure or the like in the incinerator which is in communication with the chimney stack 12. When an explosion or the like occurs in the incinerator the fluid pressure within the chimney stack 12 increases, and the fluid pressure may increase to a magnitude in which the fluid pressure within the chimney stack 12 forces the closure member 34 upwardly and away from the opening in the upper portion of the chimney stack 12. Thus, the closure member 34 is lifted from the upper portion of the chimney stack 12, as illustrated in FIG. 4. Arrows 60 in FIG. 4 illustrate flow of fluid from the chimney stack 12 as a result of fluid pressure within the chimney stack 12. Thus, upward movement of the closure member 34 and pivotal movement of the arms 30 occurs while the arms 24 remain horizontal, as positioned by the motor member 44, as shown in FIG. 4.

Figure 3:
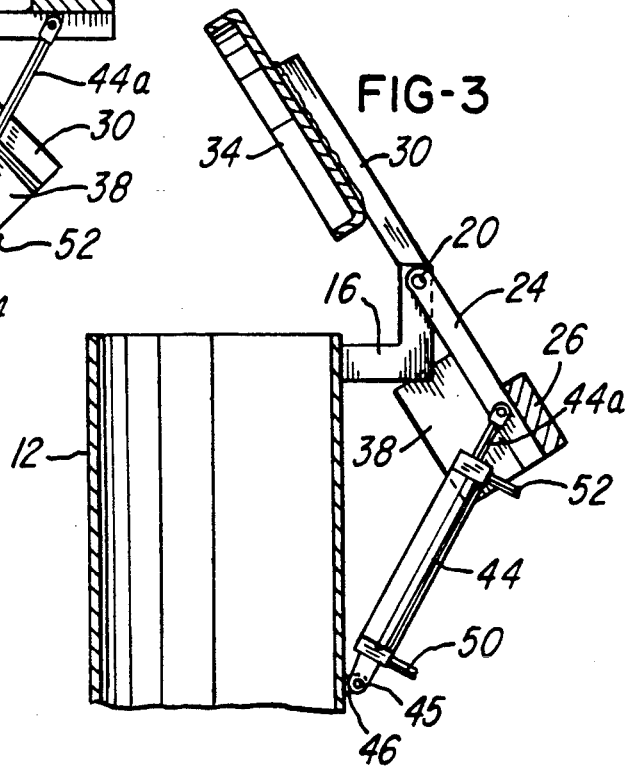
FIG. 3 is a side sectional view, similar to FIG. 2, but showing the closure member in an open position.
Figure 5:
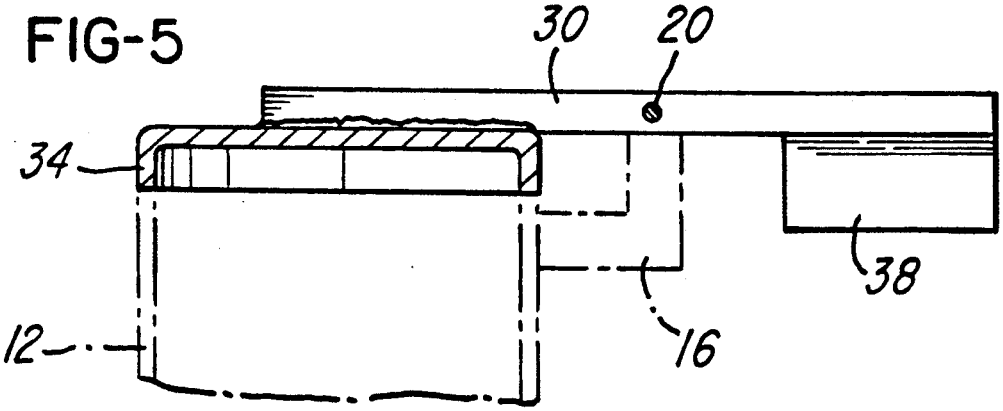
FIG. 5 is a side sectional view showing a portion of the valve mechanism and showing the upper portion of the chimney stack in phantom.

Occasions arise in which the closure member 34 must be removed from the opening in the upper portion of the chimney stack 12 and when there is little or no significant fluid pressure within the chimney stack 12. On such occasions the motor member 44 is operated to move the actuator member 44*a* downwardly and the arms 24 are pivotally moved downwardly. The arms 24 are pivotally moved downwardly and the engagement member 26 engages the arms 30 and pivotally moves the arms 30 downwardly. Thus, the arms 30 are pivotally moved to lift the closure member 34 from the chimney stack 12, as illustrated in FIG. 3.

If the motor member 44 should fail to operate properly, fluid pressure urging the actuator member 44*a* upwardly would not exist. Therefore, the engagement member 26 would rest upon the arms 30, and the weight of the engagement member 26 upon the arms 30 is such as to force the arms 30 to pivotally move downwardly, and the closure member 34 is lifted from the chimney stack 12, as illustrated in FIG. 3. Thus, the valve mechanism of this invention "fails safe".

Although the preferred embodiment of the incinerator chimney stack valve mechanism of this invention has been described, it will be understood that within the purview of this invention various changes may be made in the form, details, proportion and arrangement of parts, the combination thereof, and the mode of operation, which generally stated consist in an incinerator chimney stack valve mechanism within the scope of the appended claims.

The invention having thus been described, the following is claimed.

1. Dual operation incinerator chimney stack valve mechanism for an incinerator chimney stack having an opening therein, comprising: a first arm member pivotally attached to the incinerator chimney stack adjacent the opening in the chimney stack, a closure member attached to the first arm member, the closure member having a given weight, the first arm member being pivotally movable to position the closure member in a position closing the opening in the incinerator chimney stack as the weight of the closure member normally positions the closure member in a position closing the opening in the incinerator chimney stack, the first arm member being pivotally movable to position the closure member in spaced relationship from the opening in the chimney stack when pressure within the incinerator chimney stack forces the closure member from the opening in the chimney stack, motor means, support means supporting the motor means upon the incinerator chimney stack, a second arm member pivotally attached to the incinerator chimney stack adjacent the first arm member, connector means operably connected to the motor means and to the second arm member for pivotal movement of the second arm member by the motor means, engagement means carried by the second arm member and engageable with the first arm member for pivotal movement of the first arm member for movement of the closure member away from the opening in the incinerator chimney stack with pivotal movement of the second arm member, whereby the closure member is movable from the opening in the incinerator chimney stack by pressure within the incinerator chimnay stack and whereby the closure member is movable from the opening in the incinerator chimney stack by pivotal movement of the second arm member as the second arm member is pivotally moved by the motor means and as the second arm member pivotally moves the first arm member.

2. Dual operation incinerator chimney stack valve mechanism for an incinerator chimney stack having an opening therein, comprising: a first arm member, means pivotally attaching the first arm member to the incinerator chimney stack adjacent the opening in the incinerator chimney stack, a closure member attached to the first arm member, the first arm member being pivotally movable to position the closure member in a position closing the opening in the incinerator chimney stack as the closure member normally closes the opening in the chimney stack, the first arm member being pivotally movable to position the closure member in spaced relationship from the opening in the chimney stack, the first arm member being pivotally movable by pressure within the incinerator chimney stack applied to the closure member when the closure member closes the opening in the incinerator chimney stack, a second arm member, means pivotally attaching the second arm member to the incinerator chimney stack, motor means, support means supporting the motor means adjacent the second arm member, connector means joining the motor means to the second arm member for pivotal movement of the second arm member by the motor means, operator means carried by the second arm member and operable upon the first arm member for pivotal movement of the first arm member with pivotal movement of the second arm member for movement of the closure member with respect to the opening in the incinerator chimney stack, whereby the closure member is movable from the opening in the incinerator chimney stack by pressure in the incinerator chimney stack, and whereby the closure member is movable from the opening in the incinerator chimney stack by operation of the motor means.

3. The incinerator chimney stack valve mechanism of claim 2 in which the operator means carried by the second arm member includes engagement means engageable with the first arm member for pivotal movement of the first arm member.

4. Incinerator chimney stack valve mechanism for a chimney stack having an opening therein, comprising: an arm member, means pivotally attaching the arm member to the incinerator chimney stack adjacent the opening in the chimney stack, a closure member attached to the arm member, the arm member being pivotally movable to position the closure member in a position closing the opening in the chimney stack as the closure member normally closes the opening in the chimney stack, the arm member being pivotally movable to position the closure member in spaced relationship from the opening in the chimney stack, motor means, support means supporting the motor means adjacent the arm member, movable operator means operable by the motor means and relatively movable with respect to the arm member for pivotal movement of the arm member for movement of the closure member with respect to the opening in the chimney stack, the operator means including engagement means freely movable with respect to the arm member but engageable with the arm member for pivotal movement of the arm member.

5. The incinerator chimney stack valve mechanism of claim 2 in which the first arm member is normally horizontal and in which the motor means is normally activated and in which the operator means includes an engagement member which is normally maintained by the second arm member and by the motor means in a given position above the first arm member, and in which the engagement means is movable downwardly by gravity into engagement with the first arm member with pivotal movement of the second arm member to urge pivotal movement of the first arm member in the event of operational failure of the motor means, whereby the closure member is moved from the opening in the incinerator chimney stack when operational failure of the motor means occurs.

6. The incinerator chimney stack valve mechanism of claim 2 in which the first arm member is normally horizontal and in which the motor means comprises a linearly reciprocal pressure operable motor member including an extensible actuator element and in which the actuator element is normally extended by pressure within the motor member and in which the actuator element is attached to the second arm member and retains the second arm member in normal position with respect to the first arm member and in which the actuator element is permitted to move from an extended position when pressure within the motor means ceases, whereby when pressure within the motor means ceases the second arm member is permitted to move with respect to the first arm member and whereby the operator means operates upon the first arm member and whereby the first arm member is pivotally moved and moves the closure member from the opening in the incinerator chimney stack, whereby the motor means is fail safe in closure member operation.

7. Dual operation chimney stack valve mechanism for a chimney stack having an opening therein, comprising: a first arm member pivotally attached to the chimney stack adjacent the opening in the chimney stack, a closure member attached to the first arm member, the first arm member being pivotally movable to a position in which the closure member closes the opening in the chimney stack, the closure member having a given weight which normally maintains the pivotal position of the first arm member in which the closure member is in closing relationship with respect to the opening in the chimney stack, the first arm member being pivotally movable to a position in which the closure member is in spaced relationship from the opening in the chimney stack, the first arm member being pivotally movable by pressure within the chimney stack as pressure within the chimney stack forces the closure member from the opening in the chimney stack, motor means, support means supporting the motor means upon the chimney stack, a second arm member, means supporting the second arm member adjacent the first arm member, operator means operably connected to the motor means and to the second arm member for movement of the second arm member by the motor means, and an engagement member carried by the second arm member and engageable with the first arm member for pivotal movement of the first arm member to a position in which the closure member is in spaced relationship from the opening in the chimney stack, whereby the closure member is movable from the opening in the chimney stack by pressure within the chimney stack and whereby the closure member is movable from the opening in the chimney stack by operation of the motor means.

8. Incinerator chimney stack valve mechanism for a chimney stack having an opening therein, comprising: a first arm member pivotally attached to the incinerator chimney stack adjacent the opening in the chimney stack, a closure member attached to the first arm member, the first arm member being pivotally movable to a substantially horizontal position in which the closure member closes the opening in the chimney stack, the closure member having a given weight which normally maintains the closure member in closing relationship with respect to the opening in the chimney stack, the first arm member being pivotally movable to an angular position in which the closure member is in spaced relationship from the opening in the chimney stack, motor means, support means supporting the motor means upon the chimney stack adjacent the first arm member, a second arm member pivotally attached to the incinerator chimney stack adjacent the opening in the chimney stack, operator means operably connected to the motor means for pivotal movement of the second arm member, and an engagement member carried by the second arm member and engageable with the first arm member for pivotal movement of the first arm member to an angular position for positioning the closure member in spaced relationship from the opening in the chimney stack, the first arm member having an engagement portion spaced from the closure member, the engagement member which is carried by the second arm member being positioned above the engagement portion of the first arm member, whereby the engagement member of the second arm member is engageable with the engagement portion of the first arm member with downward movement of the engagement member for pivotal movement of the first arm member for movement of the closure member away from the opening in the chimney stack.

9. Dual operation chimney stack valve mechanism for a chimney stack having an opening therein, comprising: an arm member pivotally attached to the chimney stack adjacent the opening in the chimney stack, a closure member attached to the arm member, the arm member being pivotally movable to a substantially horizontal position in which the closure member closes the opening in the chimney stack, the closure member having a given weight which normally maintains the closure member in closing relationship with respect to the opening in the chimney stack, the arm member being pivotally movable to an angular position in which the closure member is in spaced relationship from the opening in the chimney stack, whereby the closure member is forced from a position closing the opening in the chimney stack when fluid pressure within the chimney stack is pressure in magnitude, and whereby excessive fluid pressure within the chimney stack is automatically relieved by pivotal movement of the arm member with movement of the closure member from the opening in the chimney stack, motor means, means operable by the motor means for pivotal movement of the arm member for moving the closure member from the opening in the chimney stack whereby the closure member is movable from the chimney by pressure in the chimney stack, and whereby the closure member is movable from the chimney stack by operation of the motor means.

10. Incinerator chimney stack valve mechanism for a chimney stack having an opening therein, comprising: an arm member pivotally attached to the incinerator chimney stack adjacent the opening in the chimney stack, a closure member attached to the arm member, the arm member being pivotally movable to a substantially horizontal position in which the closure member closes the opening in the chimney stack, the closure member having a given weight which normally maintains the closure member in closing relationship with respect to the opening in the chimney stack, the arm member being pivotally movable to an angular position in which the closure member is in spaced relationship from the opening in the chimney stack, whereby the closure member is forced from a position closing the opening in the chimney stack when fluid pressure within the chimney stack is of sufficient magnitude, and whereby excessive fluid pressure within the chimney stack is automatically relieved by pivotal movement of the arm member with movement of the closure member from the opening in the chimney stack, a second arm member which is supported by the chimney stack, means carried by the second arm member for pivotal movement of the first arm member, motor means, connection means connecting the motor means to the second arm member for movement of the second arm member for pivotal movement of the first said arm member, the valve mechanism including an engagement member, the motor means being normally attached to the second arm member whereby the motor means normally maintains the second arm member in a position in which the engagement member is above the first arm member, and whereby the engagement member has a weight sufficient to pivotally move the first said arm member to move the closure member from the opening in the chimney stack in the event that the motor means should fail to function properly.

11. An incinerator chimney stack valve mechanism for a vertical chimney stack having a horizontal upper end forming an opening therein, comprising a first arm member pivotally attached to the chimney stack adjacent the upper end thereof, the first arm member being pivotally movable between a horizontal position and an angular position, a closure member attached to the first arm member and positioned to close the opening in the upper end of the chimney stack when the first arm member is horizontal, the weight of the closure member being such that the first arm member is normally horizontal with the closure member closing the opening in the chimney stack, the closure member being positioned in spaced relationship from the upper end of the chimney stack when the first arm member is an angular position, a second arm member pivotally attached to the chimney stack adjacent the upper end thereof, the second arm member including an engagement portion which is engageable with the first arm member for moving the first arm member from a horizontal position to an angular position, and means for pivotally moving the second arm member for engaging the first arm member for pivotal movement of the first arm member from a horizontal position to an angular position, the engagement portion of the second arm member being positioned above the first arm member and having sufficient weight to pivotally move the first arm member when the engagement portion of the second arm member engages the first arm member whereby the first arm member is automatically pivotally moved to an angular position if the means for pivotally moving the second arm member fails to function.

* * * * *

UNITED STATES PATENT AND TRADEMARK OFFICE

CERTIFICATE OF CORRECTION

PATENT NO. : 5,092,226

DATED : March 3, 1992

INVENTOR(S): James P. McCloskey

It is certified that error appears in the above-identified patent and that said Letters Patent is hereby corrected as shown below:

Title Page:

[57] Abstract, line 11, after "engagement" insert ---member---.

Signed and Sealed this

Twenty-fifth Day of May, 1993

Attest:

Michael K. Kirk

MICHAEL K. KIRK

Attesting Officer

Acting Commissioner of Patents and Trademarks